US008950554B2

(12) United States Patent
Niikawa

(10) Patent No.: US 8,950,554 B2
(45) Date of Patent: Feb. 10, 2015

(54) ELEVATOR GOVERNOR

(75) Inventor: Takeshi Niikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 660 days.

(21) Appl. No.: 13/145,286

(22) PCT Filed: Apr. 9, 2009

(86) PCT No.: PCT/JP2009/057251

§ 371 (c)(1),
(2), (4) Date: Jul. 19, 2011

(87) PCT Pub. No.: WO2010/116503

PCT Pub. Date: Oct. 14, 2010

(65) Prior Publication Data

US 2011/0272217 A1 Nov. 10, 2011

(51) Int. Cl.
*B66B 5/04* (2006.01)

(52) U.S. Cl.
CPC ..... *B66B 5/044* (2013.01)
USPC ..... 187/305

(58) Field of Classification Search
CPC ..... B66B 5/044
USPC ..... 187/305, 373, 288
See application file for complete search history.

(56) References Cited

U.S. PATENT DOCUMENTS 5,653,312 A * 8/1997 Kato ..... 187/350
6,360,847 B1 3/2002 Okada et al.

(Continued)

FOREIGN PATENT DOCUMENTS

EP 1 770 044 A1 * 4/2007
EP 2 602 222 A1 * 12/2013

(Continued)

OTHER PUBLICATIONS

International Search Report issued Jul. 7, 2009 in PCT/JP09/57251 filed Apr. 9, 2009.

(Continued)

*Primary Examiner* — William E Dondero
*Assistant Examiner* — Diem Tran
(74) *Attorney, Agent, or Firm* — Oblon, Spivak, McClelland, Maier & Neustadt, L.L.P.

(57) ABSTRACT

Provided is an elevator governor capable of achieving, with a simple configuration, an overspeed detection mechanism to which rotation dependence is added while preventing a decrease in reliability due to the generation of vibrations and noises and the wear of parts. For this purpose, the elevator governor includes: a sheave on which a rope moving in response to the movement of an ascending and descending body of an elevator is wound, and which changes the rotation speed in one direction in response to the ascent speed of the ascending and descending body and changes the rotation speed in the other direction in response to the descent speed of the ascending and descending body; a fly-weight which is provided in the sheave and increases and decreases an outward moving quantity in response to an increase and decrease in the rotation speed of the sheave; a detector which is provided in proximity to the fly-weight and performs overspeed detection of the sheave when the fly-weight has moved outward by a predetermined quantity; and a stopper which is provided in proximity to the fly-weight and prevents the fly-weight from moving outward more than or equal to the predetermined quantity while the sheave is rotating in a predetermined direction which is either of the two rotation directions.

8 Claims, 6 Drawing Sheets

(56) References Cited

U.S. PATENT DOCUMENTS

| | | | | |
|---|---|---|---|---|
| 2011/0127116 | A1 | 6/2011 | Niikawa | |
| 2011/0186385 | A1 * | 8/2011 | Okada | 187/288 |

FOREIGN PATENT DOCUMENTS

| | | |
|---|---|---|
| JP | 50 152456 | 12/1975 |
| JP | 2000 327241 | 11/2000 |
| WO | 2008 047425 | 4/2008 |
| WO | 2009 019780 | 2/2009 |

OTHER PUBLICATIONS

International Preliminary Report on Patentability issued Nov. 24, 2011, in PCT/JP2009/057251 (English-language translation only).
Written Opinion of the International Searching Authority issued Jul. 7, 2009, in PCT/JP2009/057251 (English-language translation only).

* cited by examiner

ELEVATOR GOVERNOR

TECHNICAL FIELD

The present invention relates to an elevator governor.

BACKGROUND ART

There are disk type governors and fly ball type governors as elevator governors which have hitherto been widely used. Overspeed detection mechanisms of conventional governors represented by these types of governors have no rotation direction dependence. For this reason, overspeed detection is performed at the same speed in all rotation directions.

However, for example, in a car-side governor of an elevator in which the ascent speed of a car is higher than the decent speed, an overspeed detection mechanism set so as to be adapted to the descent speed of the car operates also during the ascent of the car. For this reason, this has posed the problem that it is impossible to perform overspeed detection adapted to each of the ascent speed and the descent speed of the car.

In contrast to this, there have been proposed governors which are such that one governor is provided with two independent overspeed detection mechanisms having different detection operation speeds. In such governors, however, the rotation of a sheave is transmitted to an overspeed detection mechanism having a lower detection operation speed via a ratchet. On the other hand, the rotation of a sheave is not transmitted to the other overspeed detection mechanism having a higher direction operation speed, because the ratchet becomes free. As a result of this, in the car-side governor of an elevator in which the ascent speed of a car is higher than the descent speed, it is possible to carry out overspeed detection adapted to each of the ascent speed and the descent speed (refer to Patent Document 1, for example).

Patent Document 1: Japanese Patent Laid-Open No. 2000-327241

DISCLOSURE OF THE INVENTION

Problems to be Solved by the Invention

However, the governor disclosed in Patent Document 1 has had the problem that while rotating is performed in the direction in which the ratchet becomes free, vibrations and noises are generated from the ratchet and besides the safety and reliability of the governor as a safety part of the elevator decrease due to the wear of parts of the ratchet.

In the case where in an elevator in which the ascent speed of a car is higher than the descent speed, a weight-side safety gear is applied and a weight-side governor is provided, it is not always necessary that the overspeed detection in the ascent direction of a car be carried out by a car-side governor. However, providing a weight-side governor has had the problem that the configuration becomes redundant, resulting in high cost.

The present invention was made to solve the problems described above, and the object of the invention is to provide an elevator governor capable of achieving, with a simple configuration, an overspeed detection mechanism to which rotation dependence is added while preventing a decrease in reliability due to the generation of vibrations and noises and the wear of parts.

Means for Solving the Problems

A elevator governor includes a sheave on which a rope moving in response to the movement of an ascending and descending body of an elevator is wound, and which changes the rotation speed in one direction in response to the ascent speed of the ascending and descending body and changes the rotation speed in the other direction in response to the descent speed of the ascending and descending body, a fly-weight which is provided in the sheave and increases and decreases an outward moving quantity in response to an increase and decrease in the rotation speed of the sheave, a detector which is provided in proximity to the fly-weight and performs overspeed detection of the sheave when the fly-weight has moved outward by a predetermined quantity, and a stopper which is provided in proximity to the fly-weight and prevents the fly-weight from moving outward more than or equal to the predetermined quantity while the sheave is rotating in a predetermined direction which is either of the two rotation directions.

Advantages of the Invention

According to the present invention, it is possible to achieve, with a simple configuration, an overspeed detection mechanism to which rotation dependence is added while preventing a decrease in reliability due to the generation of vibrations and noises and the wear of parts.

DESCRIPTION OF SYMBOLS

1 governor, 2 sheave, 3 main shaft, 4 governor rope, 5 fly-weight, 6 pin, 7 link, 8 link, 9 balance spring, 10 spring force adjusting nut, 11 dog, 12 actuating cam, 13 governor switch, 14 rope catch, 15 hook, 16 pin, 17 fixed shoe, 18 stopper, 19 locking notched portion, 20 connecting notched portion, 21 lever, 22 one end, 23 other end, 24 pin, 25 pin, 26 tension spring, 27 linear-motion bearing, 28 fixed portion, 29 fly-weight, 30 spring force adjusting nut, 31 balance spring, 32 rotary body.

BEST MODE FOR CARRYING OUT THE INVENTION

The best mode for carrying out the present invention will be described with reference to the accompanying drawings. In each of the drawings, the same reference symbols refer to the same or corresponding parts and overlaps of descriptions of such parts are appropriately simplified or omitted.

Embodiment 1

In general, the shaft of an elevator is formed from a space extending in the vertical direction through the floors of a building. A machine room is provided in the upper part of this shaft. A traction machine is provided in this machine room. A hoisting rope is wound on this traction machine. A car of the elevator is suspended at an end of this hoisting rope. On the other hand, a weight is suspended at the other end of the hoisting rope. And the rotation of the traction machine is controlled by a controller. And the car and the weight ascend and descend at a set speed by responding to the rotation of the traction machine.

A safety gear device is provided in the lower part of the car. An endless governor rope is connected to this safety gear device via an arm. A curved portion at the lower end of this governor rope is wound on a governor tension sheave. On the other hand, a curved portion at the upper end of the governor rope is wound on a sheave of the governor provided in the machine room or the like. Hereinafter, the governor of this embodiment will be described in more detail with the aid of FIGS. 1 to 5.

Figure 1:
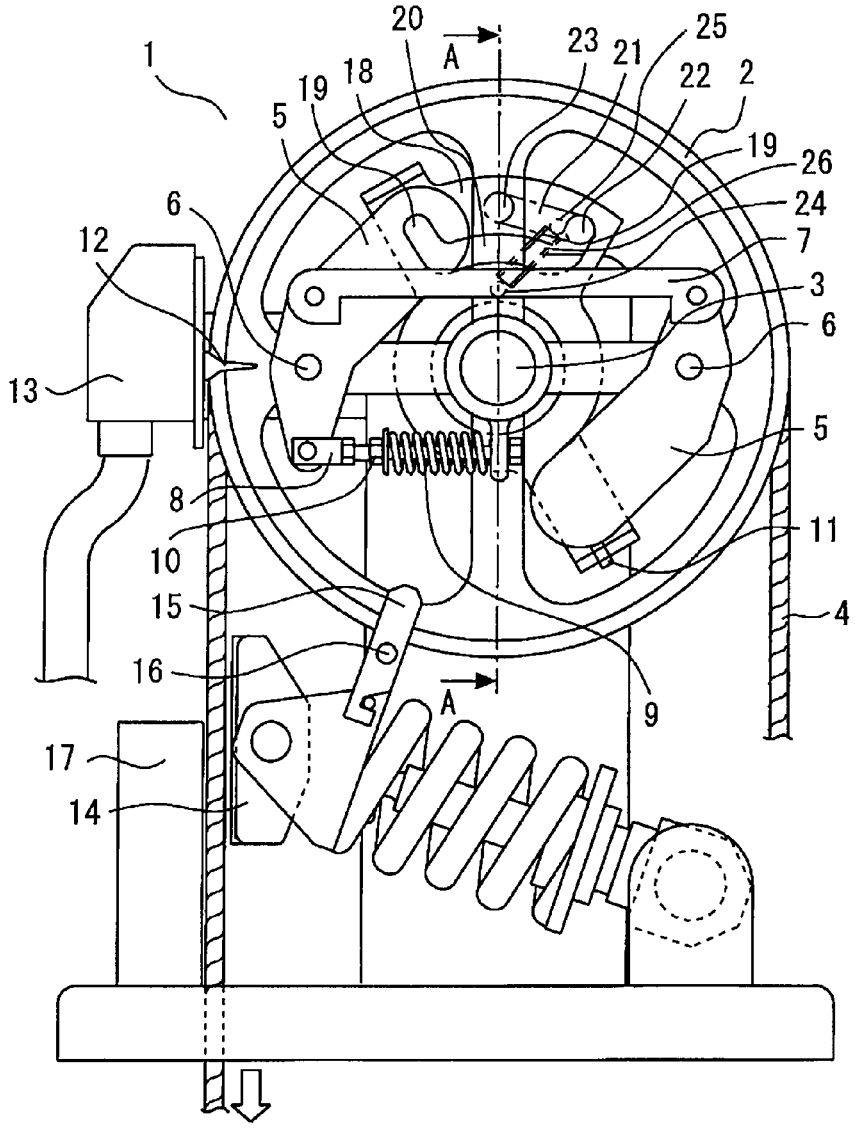
FIG. 1 is a front view of an elevator governor in Embodiment 1 of the present invention.
Figure 2:
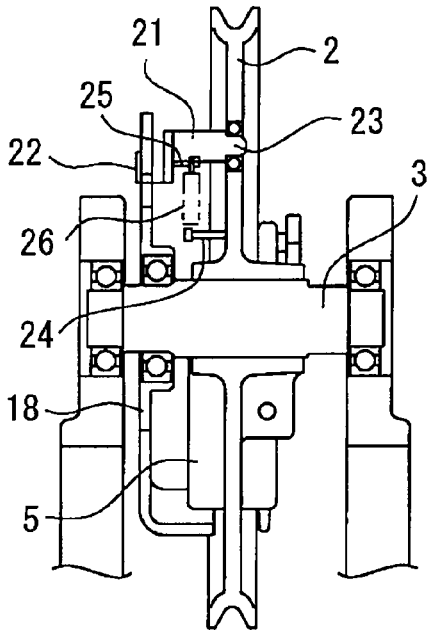
FIG. 2 is a sectional view taken along line A-A of FIG. 1.

FIG. 1 is a front view of an elevator governor in Embodiment 1 of the present invention. FIG. 2 is a sectional view taken along line A-A of FIG. 1.

In FIGS. 1 and 2, reference numeral 1 denotes a governor. This governor 1 is provided with a sheave 2. This sheave 2 is pivotally supported on a main shaft 3. A governor rope 4 is wound on the sheave 2.

This governor rope 4 is attached to a car in an endless manner. This governor rope 4 moves in response to the movement of the car. And the governor rope 4 rotates the sheave 2 in response to the ascent and descent of the car. That is, the sheave 4 changes the rotation speed in one direction according to the ascent speed of the car and changes the rotation speed in the other direction according to the descent speed of the car.

A pair of disk type fly-weights 5 is rotatably provided on a side surface of this sheave 2 via a pin 6. These fly-weights 5 increase and decrease the moving quantity of the sheave 2 to the radial outside of the sheave 2 along the side surface of the sheave 2 as a result of an increase and decrease in the rotation speed of the sheave 2. These fly-weights 5 are connected by a link 7. As a result of this, it is ensured that the two fly-weights 5 have the same rotation angle.

A balance spring 9 is provided at an end of one of the fly-weights 5 via a link 8. This balance spring 9 constantly urges the one of the fly-weights 5 to the center side of the sheave 2. A spring force adjusting nut 10 is provided in the link 8. This spring force adjusting nut 10 is intended for adjusting the urging force of the balance spring 9. Furthermore, a dog 11 is provided at an end of the other fly-weight 5 in such a manner as to be directed to the radial outside of the sheave 2.

An actuating cam 12 is provided in proximity to the side of one side portion of the sheave 2. This actuating cam 12 is provided in a governor switch 13. And it is ensured that the governor switch 13 comes into action when the actuating cam 12 moves up and down. Furthermore, below one side portion of the sheave 2, a rope catch 14 is provided in proximity to the governor rope 4 on the side where the car is mounted.

This rope catch 14 is suspended by being caught by the lower end of a hook 15. This hook 15 is pivotally supported in the center via a pin 16. A fixed shoe 17 is provided on a side opposed to the rope catch 14. As a result of this, the governor rope 4 is surrounded by the rope catch 14 and the fixed shoe 17 below one side portion of the sheave 2.

In this embodiment, furthermore, a stopper 18 is provided. The main body of this stopper 18 is provided in the main shaft 3 in such a manner as to be rotatable. A pair of locking notched portions 19 is provided in the main body of this stopper 18. The end portions of these locking notched portions 19 on the center side of the sheave 2 are connected by a connecting notched portion 20. And one end 22 of a lever 21 is inserted in such a manner as to be freely movable along this connecting notched portion 20. On the other hand, the other end 23 of the lever 21 is pivotally supported by the sheave 2.

On the side near the main shaft 3 rather than near the lever 21, a pin 24 is provided in the sheave 2 in such a manner as to protrude to the stopper 18 side. On the other hand, also in the lever 21, a pin 25 is provided in such a manner as to protrude to the sheave 2 side. And between these pins 24 and 25, there are provided tension spring 26. And this tension spring 26 constantly urge the lever 21 to the center side of the sheave 2.

Next, the operation of the governor 1 will be described with the aid of FIGS. 3 to 5.

Figure 3:
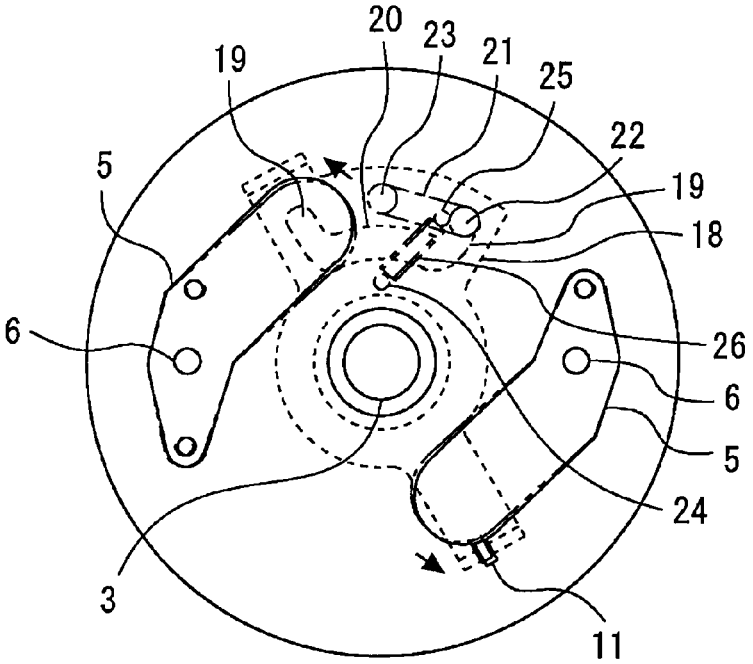
FIG. 3 is a front view showing the essential parts of the elevator governor in Embodiment 1 of the present invention.
Figure 4:
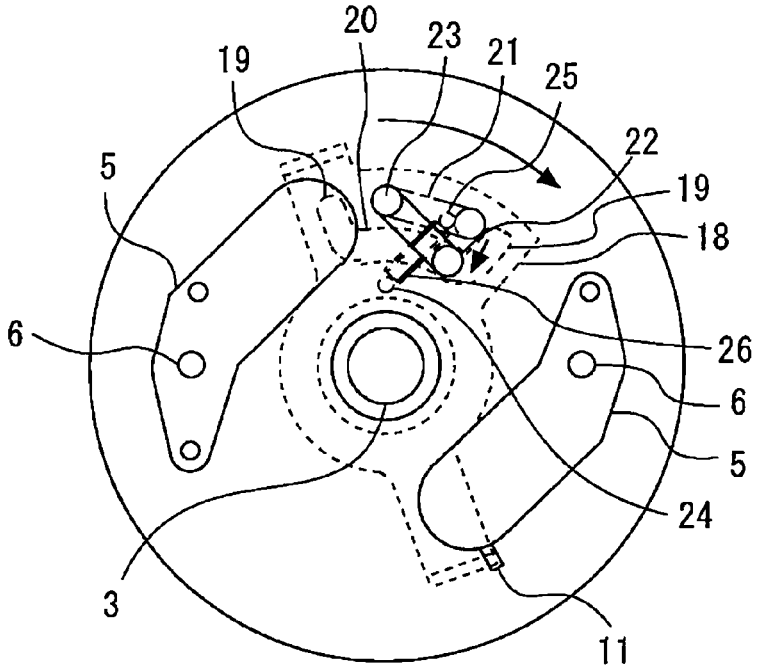
FIG. 4 is a front view showing the essential parts of the elevator governor in Embodiment 1 of the present invention.
Figure 5:
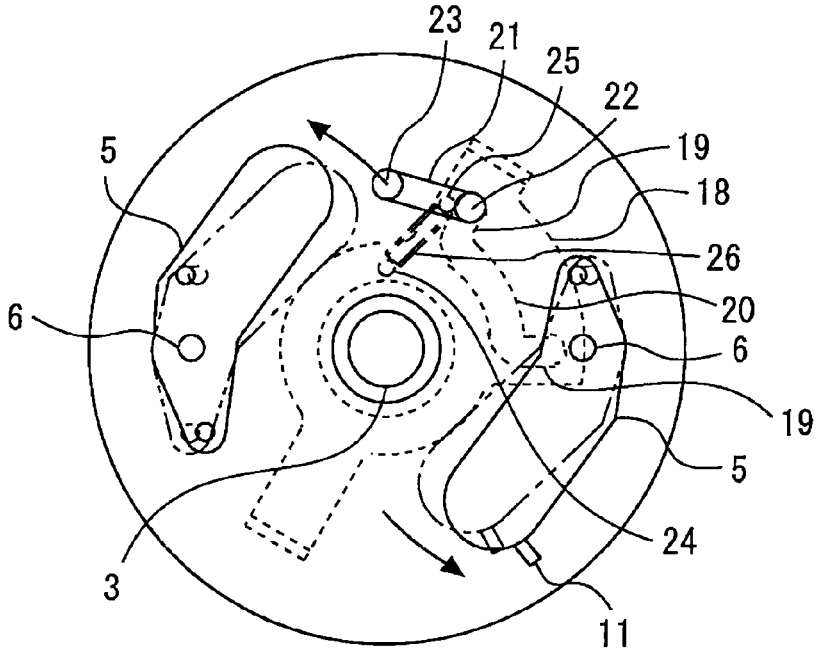
FIG. 5 is a front view showing the essential parts of the elevator governor in Embodiment 1 of the present invention.

FIGS. 3 to 5 are front views showing the essential parts of the elevator governor in Embodiment 1 of the present invention.

First, a description will be given of the operation of the governor 1 expected when the stopper 18 is not provided.

When the sheave 2 rotates in synchronization with the ascent and descent of a car, the fly-weights 5 receives a centrifugal force in response to the rotation speed of the sheave 2. In this connection, while the car is ascending and descending within a rated speed, the force by the balance spring 9 is larger than the centrifugal force applied to the fly-weights 5. For this reason, the relative position of the fly-weights 5 and the sheave 2 does not change from the initial set condition.

And when the ascent and descent speed of the car exceeds the rated speed, the centrifugal force applied to the fly-weights 5 overcomes the force of the balance spring 9. For this reason, the fly-weights 5 begin to move to the radial outside of the sheave 2.

Furthermore, when the ascent and descent speed of the car has reached a first overspeed detection speed, the dog 11 at the forward end of the fly-weight 5 abuts against the actuating cam 12. This abutment causes the governor switch 13 to operate. That is, the actuating cam 12 and the governor switch 13 function as a detector which performs the overspeed detection of the sheave 2 when the fly-weights 5 has moved outward by a predetermined quantity regardless of the ascent and descent of the car. And the power to the traction machine and brake of the elevator is interrupted by the operation of the governor switch 13. Usually, the car stops due to this interruption.

When the car does not stop and the descent speed of the car has exceeded a first overspeed detection speed and has reached a second overspeed detection speed, the fly-weights 5 move further to the radial outside of the sheave 2. This movement causes the dog 11 to abut against the upper end of the hook 15 from the actuating cam 12 side. This abutment causes the hook 15 to rotate around the pin 16. This rotation of the hook 15 causes the lower end of the hook 15 to be disengaged from the rope catch 14.

And the rope catch 14 falls under gravity and sandwiches the governor rope 4 between itself and the fixed shoe 17. As a result of this, the governor rope 4 is braked. In synchronization with the braking of this governor rope 4, the safety gear device provided in the car operates. The operation of this safety gear device causes the car to stop.

Next, a description will be given of the operation of the governor 1 expected when the stopper 18 exists. In this embodiment, the mass of the lever 21 and the load rate of the tension spring 26 are determined so that the lever 21 moves to the radial outside of the sheave 2 when the rotation speed of the sheave 2 has exceeded a predetermined threshold value.

And when the car is accelerated in the ascent direction, the stopper 18 is pressed against one end 22 of the lever 21 in the rotation direction of the sheave 2. As a result of this, the stopper 18 rotates together with the sheave 2.

And as shown in FIG. 3, when the ascent speed of the car exceeds the threshold value, one end 22 of the lever 21 moves to the radial outside of the sheave 2 due to a centrifugal force and is housed in the one of the locking notched portions 19. As a result of this, the stopper 18 is held in a condition in which the stopper 18 cannot rotate relatively with respect to the sheave 2. That is, the stopper 18 rotates together with the sheave 2.

At this time, the ascent speed exceeds the rated speed and the fly-weight 5 is almost about to move to the radial outside of the sheave 2. However, a protruding end of the stopper 18 is arranged on the radial outside of the sheave 5 with respect to the fly-weight 5. For this reason, the fly-weight 5 interferes with the protruding end of the stopper 18 when the fly-weight 5 moves more than or equal to the predetermined quantity.

Therefore, the fly-weight 5 can scarcely move to the radial outside of the sheave 2. That is, even when the ascent speed of the car has reached a first overspeed detection speed, the dog 11 at the forward end of the fly-weight 5 does not abut against the actuating cam 12. For this reason, the governor switch 13 does not operate, either.

On the other hand, when the ascent speed of the car decelerates and has lowered to the order of the threshold value, one end 22 of the lever 21 moves to the radial inside of the sheave 2, i.e., the connecting notched portion 20. For this reason, the stopper 18 becomes able to rotate relatively with respect to the sheave 2 by an amount corresponding to the length of the connecting notched portion 20.

At this time, the stopper 18 is almost about to rotate at an almost constant speed by the law of inertia even when the sheave 2 has decelerated. For this reason, as shown in FIG. 4, the stopper 18 rotates relatively with respect to the sheave 2. Subsequently, when the car has accelerated in the descent direction, the stopper 18 is pressed by one end 22 of the lever 21. As a result of this, the stopper 18 rotates together with the sheave 2.

And when the decent speed of the car has exceeded the threshold value, as shown in FIG. 5, one end 22 of the lever 21 moves due to the centrifugal force to the radial outside of the sheave 2 and is housed in the other locking notched portion 19. As a result of this, the protruding end of the stopper 18 is held at a position away from the outside of the fly-weight 5. That is, there is no object which limits the movement of the fly-weight 5. For this reason, when the descent speed of the car has reached a first overspeed detection speed and a second overspeed detection speed, overspeed detection operations suited to each speed are performed.

According to Embodiment 1 described above, the stopper 18 prevents the fly-weight 5 from moving to the radial outside of the sheave 2 more than or equal to the predetermined quantity when the sheave 2 is rotating in a predetermined direction which is either of the two rotation directions. For this reason, it is possible to achieve, with a simple configuration, an overspeed detection mechanism to which rotation dependence is added while preventing a decrease in reliability due to the generation of vibrations and noises and the wear of parts.

Also, when the sheave 2 is rotating in the predetermined direction, the main body of the stopper 18 is held by the lever 21 on the radial outside of the sheave 2 with respect to the fly-weight 5. On the other hand, when the sheave 2 is rotating in a direction reverse to the predetermined direction, the main body of the stopper 18 is held by the lever 21 on the radial outside of the sheave 2 with respect to the fly-weight 5. For this reason, it is possible to achieve, in a more stable manner, an overspeed detection mechanism to which rotation dependence is added.

Incidentally, it is preferred that the threshold value of the rotation speed of the sheave 2 which is set so that one end 22 of the lever 21 moves to the radial outside of the sheave 2, be set beforehand to the order of a half of the rated speed of the ascent and descent speeds of the car, whichever is lower. In this case, it is possible to effectively prevent unintended overspeed detection. Performing overspeed detection only when the car is running in the ascent direction, can be accomplished by configuring the stopper 18 so that the movement of the fly-weight 5 is not prevented when the sheave 2 is rotating in the ascent direction of the car.

Embodiment 2

Figure 6:
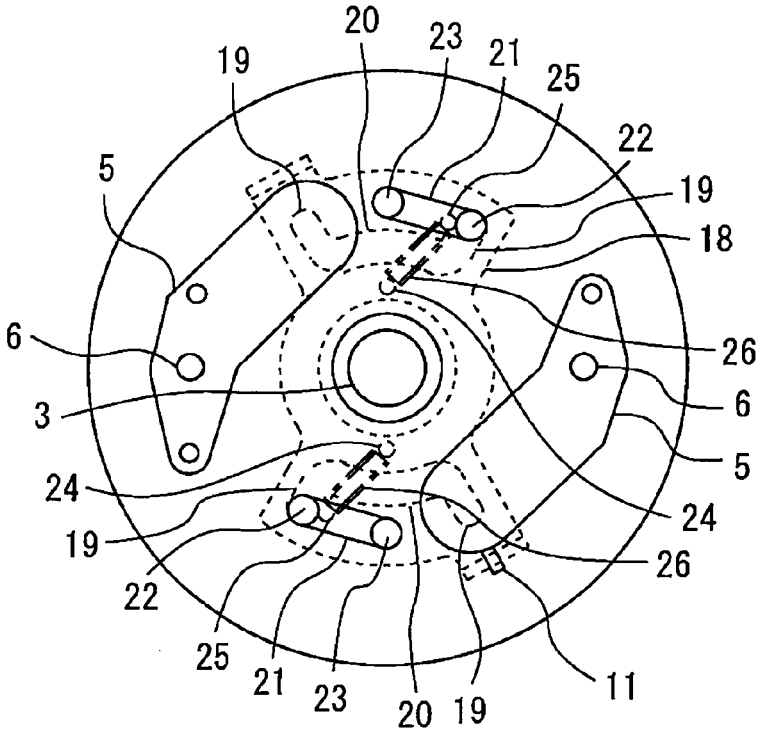
FIG. 6 is a front view showing the essential part of an elevator governor in Embodiment 2 of the present invention.

FIG. 6 is a front view showing the essential part of an elevator governor in Embodiment 2 of the present invention. Incidentally, parts which are the same as or similar to those of Embodiment 1 bear the same reference characters and description of such parts are omitted.

In Embodiment 1, the locking notched portion 19 of the stopper 18, the connecting notched portion 20, the lever 21, the pin 24, the pin 25, and the tension spring 26 are each provided in the quantity of one. On the other hand, in Embodiment 2, a plurality of the locking notched portion 19 of the stopper 18, the connecting notched portion 20, the lever 21, the pin 24, the pin 25, and the tension spring 26 are each provided symmetrically with respect to the main shaft 3.

According to Embodiment 2 described above, the load applied to the lever 21 decreases. For this reason, it is possible to increase the reliability and safety of the governor 1.

Embodiment 3

Figure 7:
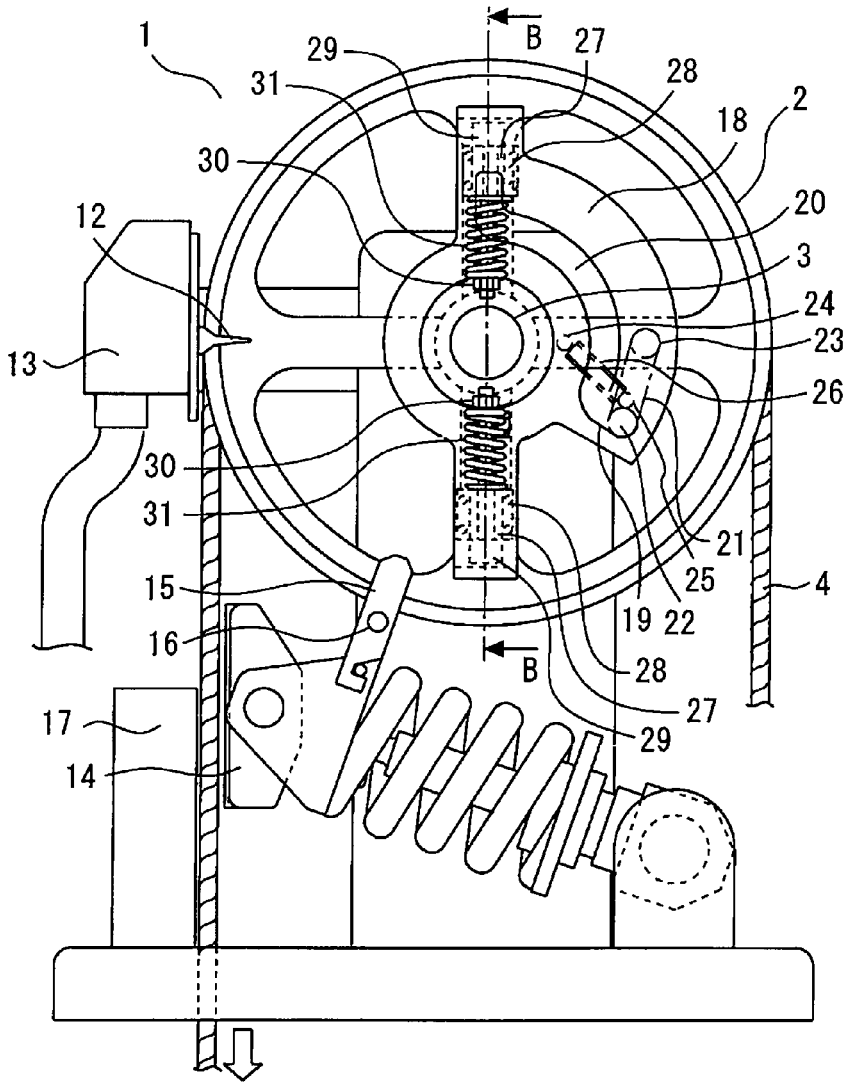
FIG. 7 is a front view of an elevator governor in Embodiment 3 of the present invention.
Figure 8:
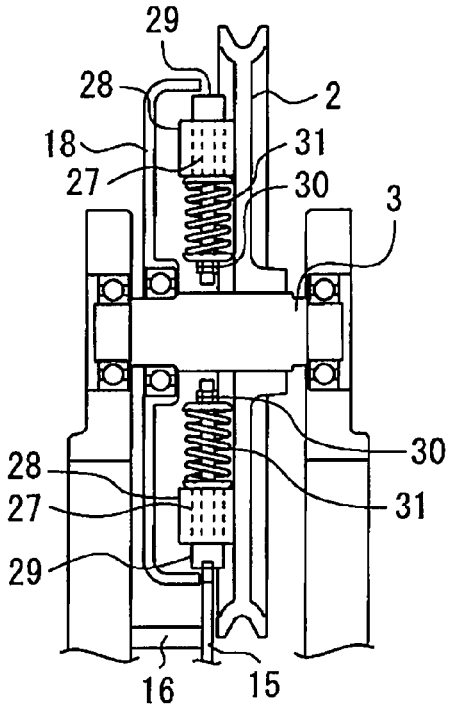
FIG. 8 is a sectional view taken along line B-B of FIG. 7.

FIG. 7 is a front view of an elevator governor in Embodiment 3 of the present invention. FIG. 8 is a sectional view taken along line B-B of FIG. 7. Incidentally, parts which are the same as or similar to those of Embodiment 1 bear the same reference characters and description of such parts are omitted.

The governor 1 of Embodiment 3 differs from the governor 1 of Embodiment 1 in the configuration of the fly-weight, the shape of the stopper 18 and the like. Hereinafter, the governor 1 of Embodiment 3 will be described.

In FIGS. 7 and 8, reference numeral 27 denotes a pair of linear-motion bearings. These linear-motion bearings 27 are attached to a side surface of the sheave 2 via a fixed portion 28. And a fly-weight 29 is inserted in each linear-motion bearings 27. The linear-motion bearings 27 may be sliding bearings using sliding friction or ball and roller bearings using the rolling friction of balls and rollers.

And a spring force adjusting nut 30 is provided in each fly-weight 29. A balance spring 31 is provided between each spring force adjusting nut 30 and each fixed portion 28. Each balance spring 31 is intended for constantly urging each fly-weight 29 to the center side of the sheave 2.

Next, a description will be given of the operation of the governor 1 expected when the stopper 18 is not provided.

When the sheave 2 rotates in synchronization with the ascent and descent of a car, the fly-weights 29 receives a centrifugal force in response to the rotation speed of the sheave 2. In this connection, while the car is ascending and descending within a rated speed, the force by each balance springs 31 is larger than the centrifugal force applied to each fly-weight 29. For this reason, the relative position of the fly-weights 29 and the sheave 2 does not change from the initial set condition.

And when the ascent and descent speed of the car exceeds the rated speed, the centrifugal force applied to each fly-weight 29 overcomes the centrifugal force of each balance spring 31. For this reason, each fly-weight 29 begins to move to the radial outside of the sheave.

Furthermore, when the ascent and descent speed of the car has reached a first overspeed detection speed, each of the forward ends of the fly-weights 29 abuts against the actuating cam 12. This abutment causes the governor switch 13 to operate. That is, the actuating cam 12 and the governor switch 13 function as a detector which performs the overspeed detection of the sheave 2 when the fly-weights 29 has moved outward by a predetermined moving quantity regardless of the ascent and descent of the car. And the power to the traction machine and brake of the elevator is interrupted by the operation of the governor switch 13. Usually, the car stops due to this interruption.

When the car does not stop and the descent speed of the car has exceeded a first overspeed detection speed and has reached a second overspeed detection speed, the fly-weights 29 moves further to the radial outside of the sheave 2. This movement causes each of the forward ends of fly-weights 29 to abut against the upper end of the hook 15 from the actuating cam 12 side. This abutment causes the hook 15 to rotate around the pin 16. The lower end of the hook 15 is disengaged from the rope catch 14. This rotation of the hook 15 causes the rope catch 14 to fall under gravity.

And the rope catch 14 falls under gravity and sandwiches the governor rope 4 between itself and the fixed shoe 17. As a result of this, the governor rope 4 is braked. In synchronization with the braking of this governor rope 4, the safety gear device provided in the car operates. As a result of this, the car stops.

Incidentally, since the operation expected when the stopper 18 is provided is the same as in Embodiment 1, the description is omitted.

According to Embodiment 3 described above, it is possible to achieve an overspeed detection mechanism, to which rotation dependence is added, having the same effect as in Embodiment 1 even when the disk type fly-weight 5 is not used.

Embodiment 4

Figure 9:
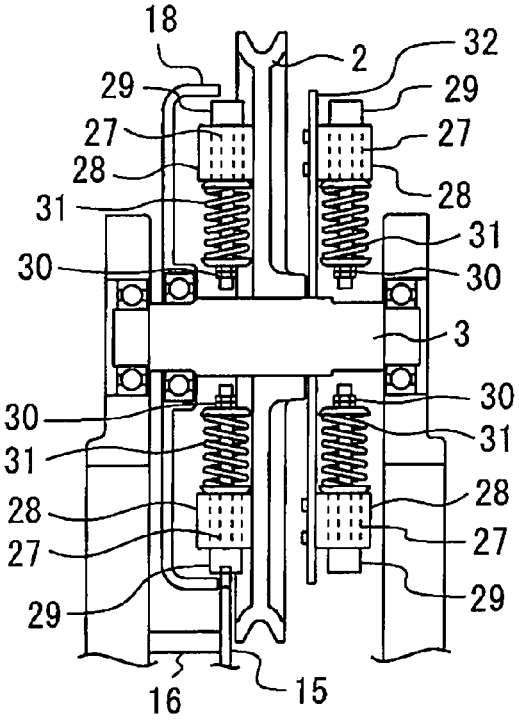
FIG. 9 is a diagram of an elevator governor in Embodiment 4 of the present invention which corresponds to FIG. 8.

FIG. 9 is a diagram of an elevator governor in Embodiment 4 of the present invention which corresponds to FIG. 8. Incidentally, parts which are the same as or similar to those of Embodiment 1 bear the same reference characters and description of such parts are omitted.

In Embodiment 3, one overspeed detection mechanism is provided. On the other hand, in Embodiment 4, two overspeed detection mechanisms are provided. These overspeed detection mechanisms operate independently from each other. Hereinafter, a governor 1 of Embodiment 4 will be described with the aid of FIG. 9.

In FIG. 9, reference numeral 32 denotes a rotary body. This rotary body 32 is fixed to one side surface of a sheave 2. That is, the rotary body 32 has the function of rotating with the sheave 2. And one of the overspeed detection mechanisms is provided on the other side surface of the sheave 2. This overspeed detection mechanism is provided with a stopper 18 which is similar to that of Embodiment 3. On the other hand, the other overspeed detection mechanism is provided on one side surface of the rotary body 32. The other overspeed detection mechanism is not provided with the stopper 18.

The one overspeed detection mechanism is set in response to a rated speed in the descent direction of the car. And it is ensured that for the one overspeed detection mechanism, the operation is limited by the stopper 18 before the speed becomes higher than the rated speed in the descent direction of the car. In contrast to this, the other overspeed detection mechanism is set in response to a rated speed in the ascent direction of the car. Such a governor 1 is provided in an elevator in which the ascent speed of the car is higher than the descent speed.

According to Embodiment 4 described above, in an elevator in which the ascent speed of the car is higher than the descent speed, it is possible to perform overspeed detection adapted to each of the ascent speed and the descent speed.

Incidentally, in an elevator in which the ascent speed of the car is lower than the descent speed, it is possible to adopt a method which is such that by use of the stopper 18, the detection speed of an overspeed detection mechanism whose operation is limited is set in response to the rated speed in the ascent direction of the car, whereas a governor 1 whose operation is not limited by the stopper 18 is set in response to the rated speed in the descent direction of the car.

In Embodiments 1 to 4 described above, the description was given of the governor 1 having the fly-weights 5 and the like which are provided in such a manner as to be movable along the side surface of the sheave 2. However, also in a fly ball type governor 1, it is possible to adopt a configuration from which similar effects are obtained. That is, when the sheave 2 rotates in a predetermined direction, by use of the stopper 18, it is possible to prevent the fly-weight from moving outward more than or equal to a predetermined moving quantity.

Furthermore, in Embodiments 1 to 4 described above, the description was given of the configuration in which the stopper 18 is provided in the car-side governor 1. However, the same effects as from Embodiments 1 to 4 can be obtained even when the stopper 18 is provided in the weight-side governor 1.

Industrial Applicability

As described above, the elevator governor of the present invention can be used in an elevator in which an ascending and descending body ascends and descends.

The invention claimed is:

1. An elevator governor comprising:

a rotatable sheave;

a rope wound on the sheave and moving in response to an ascending movement and a descending movement of a body of an elevator, whereby the sheave rotates in one of two rotational directions in response to the ascending movement of the elevator body and rotates in the other of the two rotational directions in response to the descending movement of the elevator body;

a fly-weight provided in the sheave such that an outward moving quantity of the fly-weight respectively increases and decreases in response to an increase and a decrease in a rotation speed of the sheave;

a detector provided in proximity to the fly-weight and performing overspeed detection of the sheave when the fly-weight has moved outward by a predetermined quantity; and a stopper which is provided in proximity to the fly-weight and prevents the fly-weight from moving outward more than or equal to the predetermined quantity when the sheave is rotating in a predetermined direction which is only one of the two rotation directions.

2. The elevator governor according to claim 1, further comprising two of said fly-weights wherein, for each of said fly-weights, the outward moving quantity of the fly-weight respectively increases and decreases in response to an increase and a decrease in the rotation speed of the sheave independently from the outward moving quantity of the other fly-weight, and wherein the stopper prevents either of the two fly-weights from moving outward more than or equal to the predetermined quantity when the sheave is rotating in the predetermined direction.

3. The elevator governor according to claim 2, wherein the stopper is caused to move to outside the fly-weight when the sheave is rotating in the predetermined direction, interferes with the fly-weight which has moved by a quantity smaller than the predetermined quantity, and thereby prevents the fly-weight from moving outward more than or equal to the predetermined quantity.

4. The elevator governor according to claim 3, wherein the fly-weight is provided on a side surface of the sheave and the moving quantity of the fly-weight respectively increases and decreases in response to an increase and decrease in the rotation speed of the sheave, wherein the stopper is rotatably provided along the side surface with respect to the sheave, wherein the stopper is arranged on the radial outside with respect to the fly-weight when the sheave is rotating in the predetermined direction, and wherein the stopper rotates with respect to the sheave when the sheave is rotating in a direction reverse to the predetermined direction and is arranged at a position away from the radial outside with respect to the fly-weight.

5. The elevator governor according to claim 4, wherein the stopper comprises a stopper main body which is provided in such a manner as to be rotatable along the side surface of the sheave and has a pair of locking notched portions and a connecting notched portion which connects end portions of the pair of locking notched portions, and a lever which is inserted so as to be movable to the connecting notched portion while receiving an urging force on the center side of the sheave;

wherein in the case where the sheave has rotated in the predetermined direction, the lever moves from the connecting notched portion to either of the locking notched portions and is housed in said either of the locking notched portions against the urging force when the sheave has obtained the predetermined rotation speed, and the stopper main body is held on the radial outside of the sheave with respect to the fly-weight, and wherein in the case where the sheave has rotated in a direction reverse to the predetermined direction, the lever moves from the connecting notched portion to the other locking notched portion and is housed in the other locking notched portion against the urging force when the sheave has obtained the predetermined rotation speed, and the stopper main body is held at a position away from the radial outside of the sheave with respect to the fly-weight.

6. The elevator governor according to claim 1, wherein the stopper is caused to move to outside the fly-weight when the sheave is rotating in the predetermined direction, interferes with the fly-weight which has moved by a quantity smaller than the predetermined quantity, and thereby prevents the fly-weight from moving outward more than or equal to the predetermined quantity.

7. The elevator governor according to claim 6, wherein the fly-weight is provided on a side surface of the sheave and the moving quantity of the fly-weight respectively increases and decreases in response to an increase and decrease in the rotation speed of the sheave, wherein the stopper is rotatably provided along the side surface of the sheave with respect to the sheave, wherein the stopper is arranged on the radial outside with respect to the fly-weight when the sheave is rotating in the predetermined direction, and wherein the stopper rotates with respect to the sheave when the sheave is rotating in a direction reverse to the predetermined direction and is arranged at a position away from the radial outside with respect to the fly-weight.

8. The elevator governor according to claim 7, wherein the stopper comprises a stopper main body which is provided in such a manner as to be rotatable along the side surface of the sheave and has a pair of locking notched portions and a connecting notched portion which connects end portions of the pair of locking notched portions, and a lever which is inserted so as to be movable to the connecting notched portion while receiving an urging force on the center side of the sheave;

wherein in the case where the sheave has rotated in the predetermined direction, the lever moves from the connecting notched portion to either of the locking notched portions and is housed in said either of the locking notched portions against the urging force when the sheave has obtained the predetermined rotation speed, and the stopper main body is held on the radial outside of the sheave with respect to the fly-weight, and wherein in the case where the sheave has rotated in a direction reverse to the predetermined direction, the lever moves from the connecting notched portion to the other locking notched portion and is housed in the other locking notched portion against the urging force when the sheave has obtained the predetermined rotation speed, and the stopper main body is held at a position away from the radial outside of the sheave with respect to the fly-weight.

* * * * *

UNITED STATES PATENT AND TRADEMARK OFFICE

CERTIFICATE OF CORRECTION

PATENT NO. : 8,950,554 B2
APPLICATION NO. : 13/145286
DATED : February 10, 2015
INVENTOR(S) : Takeshi Niikawa It is certified that error appears in the above-identified patent and that said Letters Patent is hereby corrected as shown below:

In the Claims

Claim 7, line 7, after "surface", delete "of the sheave".

Signed and Sealed this
Twenty-fifth Day of August, 2015

Michelle K. Lee

Michelle K. Lee
*Director of the United States Patent and Trademark Office*